US007773911B2

(12) United States Patent
Kawamura

(10) Patent No.: US 7,773,911 B2
(45) Date of Patent: Aug. 10, 2010

(54) ELECTROPHOTOGRAPHIC IMAGE FORMING APPARATUS HAVING A DRAWING MEMBER POSITIONABLE AT MOUNT AND DRAWN POSITIONS FOR MOUNTING PLURAL PROCESS CARTRIDGES

(75) Inventor: Koji Kawamura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 692 days.

(21) Appl. No.: 11/622,199

(22) Filed: Jan. 11, 2007

(65) Prior Publication Data

US 2007/0160386 A1 Jul. 12, 2007

(30) Foreign Application Priority Data

Jan. 11, 2006 (JP) ..... 2006-004105
Dec. 22, 2006 (JP) ..... 2006-346205

(51) Int. Cl.
*G03G 15/00* (2006.01)

(52) U.S. Cl. ..... 399/110; 399/111; 399/116

(58) Field of Classification Search ..... 399/110
See application file for complete search history.

(56) References Cited

U.S. PATENT DOCUMENTS

| | | | | |
|---|---|---|---|---|
| 6,647,227 | B2 * | 11/2003 | Yokoi et al. | 399/111 |
| 6,795,671 | B2 | 9/2004 | Matsuoka | 399/223 |
| 6,944,415 | B2 | 9/2005 | Nomura | 399/111 |
| 7,190,921 | B2 | 3/2007 | Ishii et al. | 399/111 |
| 2003/0059230 | A1 | 3/2003 | Yokoi et al. | 399/111 |
| 2004/0161260 | A1 * | 8/2004 | Sato | 399/111 |
| 2004/0165910 | A1 * | 8/2004 | Sato et al. | 399/116 |

FOREIGN PATENT DOCUMENTS

EP 1 457 841 A2 9/2004

(Continued)

OTHER PUBLICATIONS

International Search Report, Written Opinion of International Searching Authority, and Notification of Transmittal of International Search Report and Written Opinion of International Searching Authority for PCT Application No. PCT/JP2007/050625 issued Apr. 4, 2007.

(Continued)

*Primary Examiner*—David M Gray
*Assistant Examiner*—Roy Yi
(74) *Attorney, Agent, or Firm*—Fitzpatrick, Cella, Harper & Scinto

(57) ABSTRACT

An electrophotographic image forming apparatus detachably mounts plural process cartridges. Each cartridge includes an electrophotographic photosensitive drum, a developing roller, a drum frame and a roller frames movable between a contact position where the roller contacts the drum and a spacing position where the roller is spaced from the drum. The apparatus includes a drawing member detachably mounting the cartridges and movable substantially horizontally crossing an axial direction of the drums between a mount position where the cartridges are mounted in a main assembly of the apparatus and a drawn position drawn out of the main assembly, a spacer movable between a retracted position where the drawing member is retracted from a movement path of the cartridges to permit movement of the mounted cartridges and an operating position where the drawing member is in the movement path to move the drum frames between the contact and spacing positions.

7 Claims, 14 Drawing Sheets

FOREIGN PATENT DOCUMENTS

| | | | |
|---|---|---|---|
| EP | 1 674 950 | A1 | 6/2006 |
| JP | 2001-337511 | | 12/2001 |
| JP | 2003-215876 | | 7/2003 |
| JP | 2003-280313 | | 10/2003 |
| JP | 2005-049525 | | 2/2005 |

OTHER PUBLICATIONS

Korean Office Action dated Oct. 23, 2009, in counterpart Korean Application No. 10-2008-7016760.

* cited by examiner

ELECTROPHOTOGRAPHIC IMAGE FORMING APPARATUS HAVING A DRAWING MEMBER POSITIONABLE AT MOUNT AND DRAWN POSITIONS FOR MOUNTING PLURAL PROCESS CARTRIDGES

BACKGROUND OF THE INVENTION

1. Field of the Invention

The present invention relates to an electrophotographic image forming apparatus, for forming an image on a recording material, to which a process cartridge is detachably mountable.

Here, the electrophotographic image forming apparatus is an apparatus which forms an image on a recording material using an electrophotographic image-formation type formation type method. Examples of the electrophotographic image forming apparatus include an electrophotographic copying machine, an electrophotographic printer (a laser beam printer, an LED printer or the like), a facsimile machine and a word processor.

The process cartridge is a cartridge which contains, as a unit, an electrophotographic photosensitive drum, and process means, such as charging means for electrically charging the electrophotographic photosensitive drum, developing means and the like, and which is detachably mountable to a main assembly of the image forming apparatus.

Such a process cartridge is mounted to and demounted from the main assembly of the image forming apparatus by the user, and therefore, the maintenance operations for the main assembly of the apparatus are carried out in effect by replacing the process cartridge.

2. Description of Related Art

As disclosed in Japanese Laid-open Patent Application 2003-215876, a conventional electrophotographic image forming apparatus has mounting portions to which a plurality of the detachably mountable process cartridges are arranged in the vertical direction, wherein the mounting portions are independent from each other. A spacer member (spacing plate) for spacing and contacting the developing roller relative to the photosensitive drum is placed at a position of reduced influence on to the mounting of the process cartridge.

On the other hand, as disclosed in Japanese Laid-open Patent Application Hei 5-173375, in an electrophotographic image forming apparatus wherein the process cartridge is detachably mountable substantially in the horizontal direction, the process cartridge can be integrally drawn out, thus making the process cartridge mounting and demounting operations easy.

In such a structure, the arrangement of the spacing member for spacing or contacting the developing roller relative to the photosensitive drum has been difficult.

SUMMARY OF THE INVENTION

Accordingly, it is a principal object of the present invention to provide an electrophotographic image forming apparatus having a drawing member which is movable in the horizontal direction crossing the axial direction of the electrophotographic photosensitive drum and to which a plurality of process cartridges are demountable, wherein developing rollers are spaced from the photosensitive drum and contactable to the photosensitive drum.

It is another object of the present invention to provide a compact electrophotographic image forming apparatus having a drawing member which is movable in the horizontal direction crossing the axial direction of the electrophotographic photosensitive drum and to which a plurality of process cartridges are demountable, wherein developing rollers are spaced from the photosensitive drum and contactable to the photosensitive drum.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

General Arrangement of Electrophotographic Image Forming Apparatus

Figure 1:
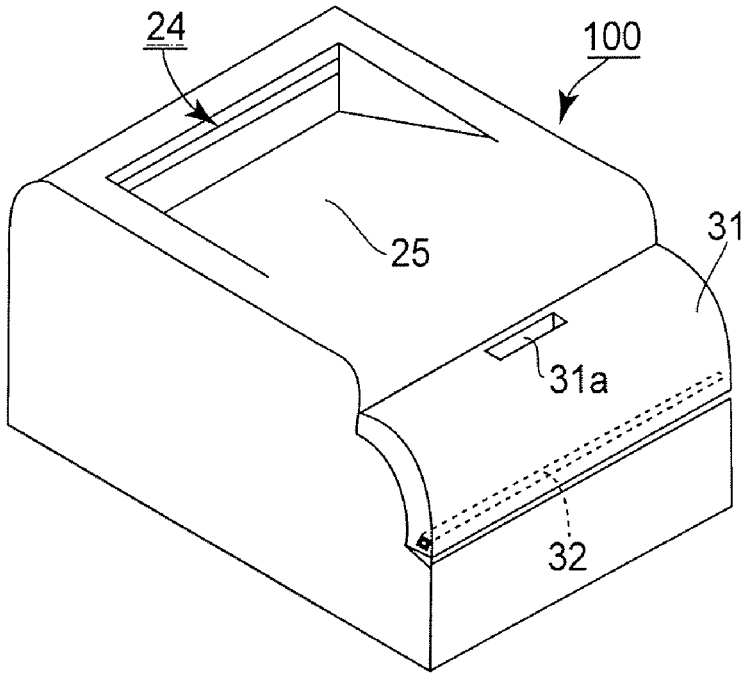
FIG. 1 is a perspective view of an electrophotographic image forming apparatus according to an embodiment of the present invention.
Figure 3:
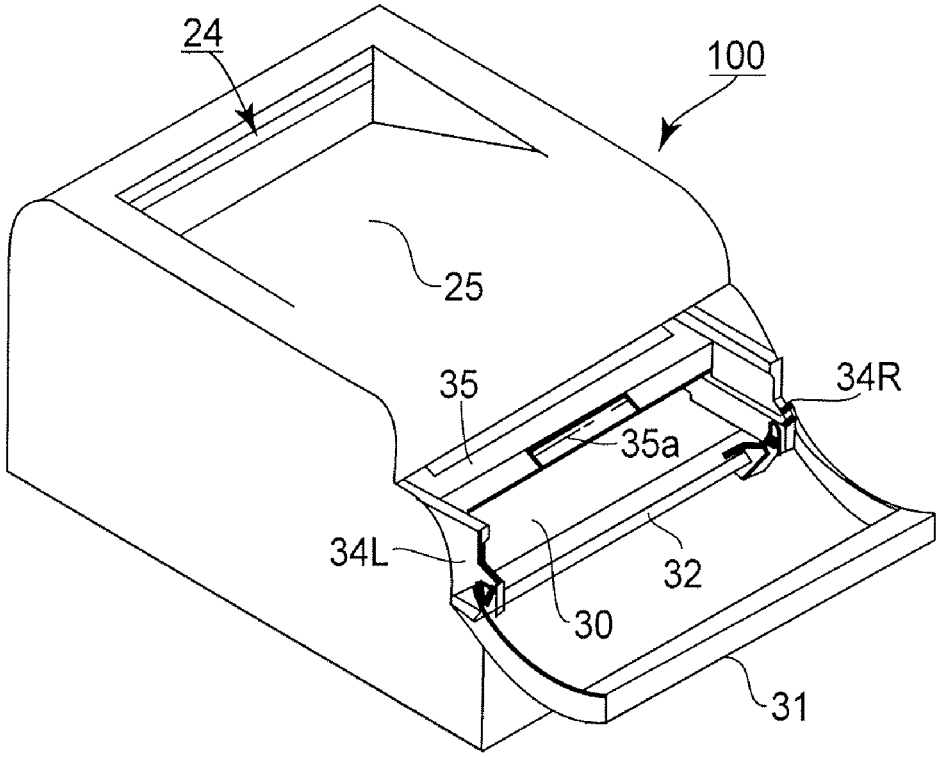
FIG. 3 is a perspective view of the electrophotographic image forming apparatus.
Figure 2:
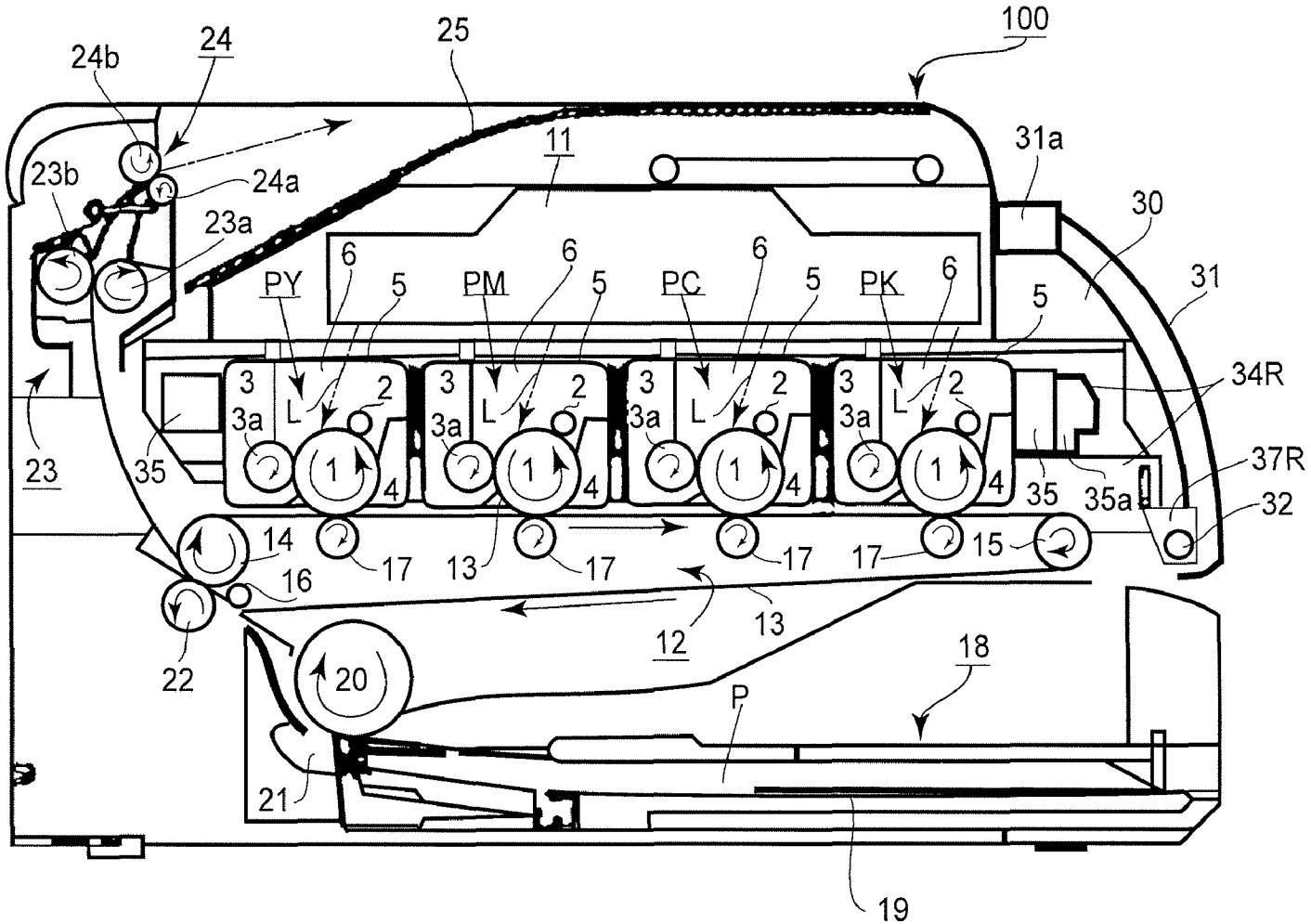
FIG. 2 is a sectional side view of the electrophotographic image forming apparatus.

FIG. 1 is a perspective view of an outer appearance of the electrophotographic image forming apparatus (image forming apparatus) according to and embodiment of the present invention and FIG. 2 is a sectional side view. As shown in FIGS. 1 and 2, the image forming apparatus 100 is a full color (four colors) laser beam printer using an electrophotographic process. The image forming apparatus 100 performs an image forming operation on a recording material (sheet) in accordance with an electrical image signal supplied from an external host apparatus (unshown) such as a personal computer, an image reader, a facsimile machine or the like.

Referring to FIG. 2, the directions which will be referred to in the following description will first be described. With respect to the image forming apparatus 100, the axial direction of the photosensitive drum 1 will be called front-rear direction. A forward direction is a direction from the back side toward the front side of the sheet of the drawing of FIG. 2, and a backward direction is a direction opposite to the forward direction. A left-right direction is a horizontal direction perpendicular to the axial direction of the photosensitive drum 1. A vertical direction is a direction of height of the image forming apparatus 100.

A plurality of process cartridges PY, PM, PC and PK are arranged in the left-right direction in the image forming apparatus 100 (in-line or tandem arrangement). The four cartridges PY, PM, PC, PK accommodate different color developers (toner), but the structures thereof are common. A description will be provided as to the cartridge PK only.

Figure 15:
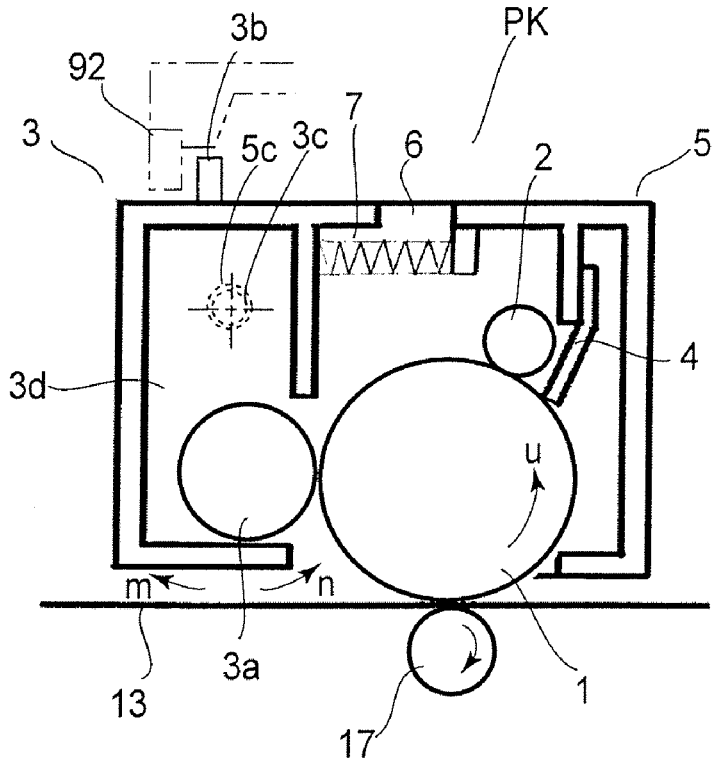
FIG. 15 is a sectional view of the process cartridge.

As shown in FIG. 15, the cartridge PK comprises a cleaning unit 5 (first frame) and a developing unit 3 (a second frame). The cleaning unit 5 includes a rotatable electrophotographic photosensitive drum 1, a charging roller 2 and a cleaning blade 4. The developing unit 3 includes a rotatable developing roller 3*a*, a developer container 3*d* accommodating the developer to be used by the developing roller 3*a*.

The developing unit 3 is supported by a supporting shaft 3*c* being supported by a supporting hole 5*c* of the cleaning unit 5. Therefore, the developing unit 3 is rotatable (movable) relative to the cleaning unit 5. The developing unit 3 is provided on the upper surface thereof with a projection 3*b* which is urged by a spacer member 92 by which the developing unit 3 is rotated in the direction of an arrow m about the supporting shaft 3*c*. By doing so, the developing roller 3*a* is spaced from the photosensitive drum 1. The position of the developing unit 3 at this time is called a spacing position. When the projection 3*b* is not urged by the spacer member 92, the spring 7 rotates the developing unit 3 in the direction of arrow n about the center. This keeps the developing roller 3*a* contacted to the photosensitive drum 1. The position of the developing unit 3 is called a contact position.

Figure 7:
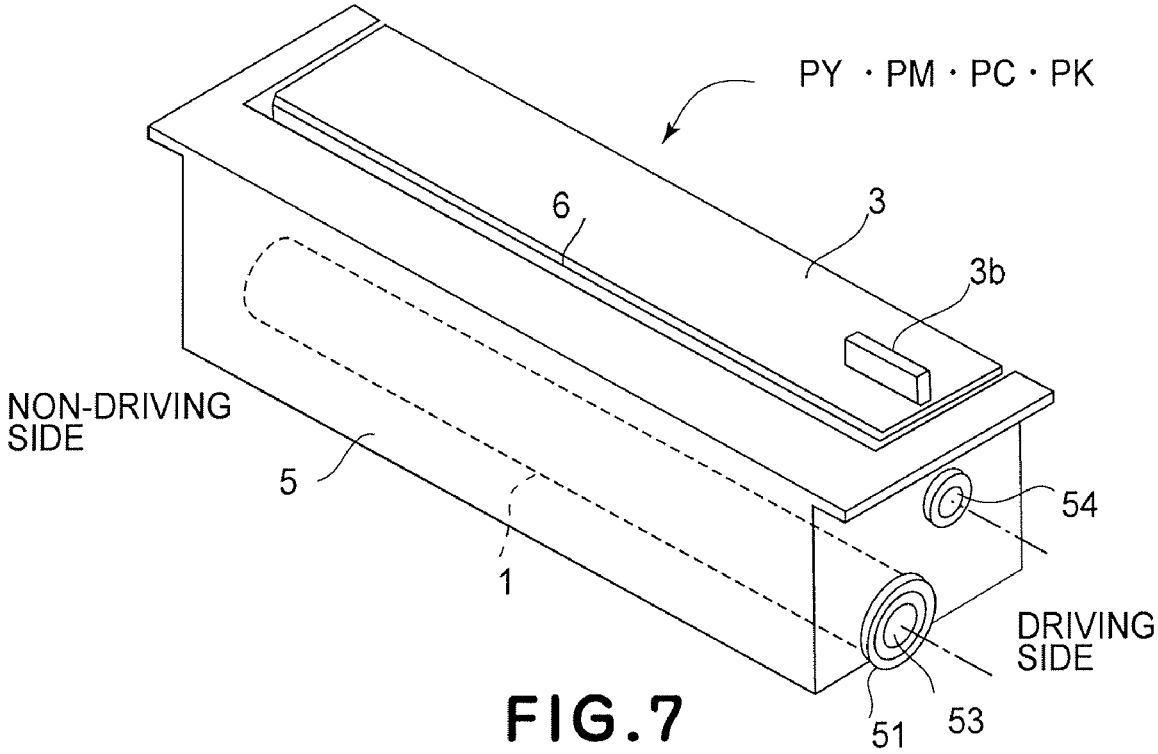
FIG. 7 is a perspective view of the process cartridge.
Figure 8:
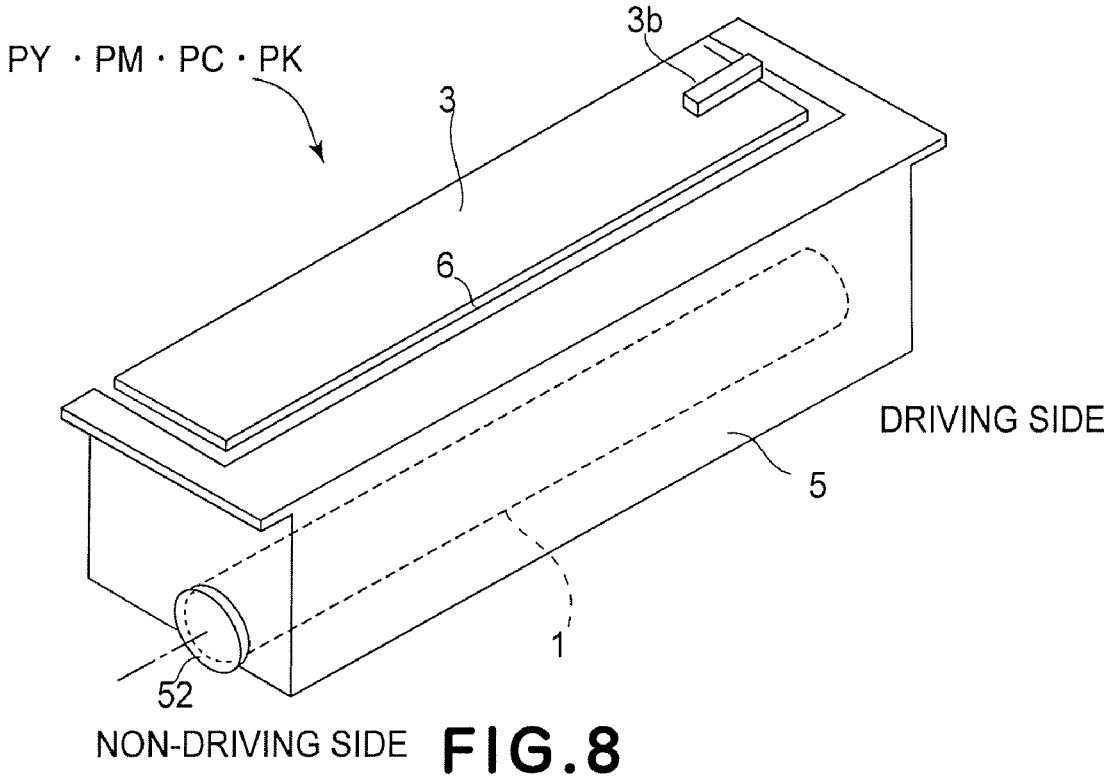
FIG. 8 is a perspective view of the process cartridge.

FIG. 7 and FIG. 8 are perspective views of an outer appearance of the cartridge. FIG. 7 is a perspective view as seen from a driving side which is a rear side of the image forming apparatus 100, and FIG. 8 is a perspective view as seen from a non-driving side which is a front side of the image forming apparatus 100.

As shown in FIGS. 7 8, each of the cartridges PY, PM, PC, PK has a substantially rectangular parallelopiped configuration which is elongated in the axial direction of the photosensitive drum 1 (front rear direction). The photosensitive drum 1 is rotatably supported by shaft receiving portions 51 and 52 disposed at the opposite ends, with respect to the axial direction (longitudinal direction), of the cartridge frame 5. Each of the cartridges PY, PM, PC is provided at the driving side with a coupling 53 functioning as an input portion for driving the drum. The coupling 53 is engageable with a main assembly coupling 39 which is provided movably in the front-rear direction to receive a driving force from a motor (unshown) provided in the image forming apparatus 100. The driving side of each of the cartridges PY, PM, PC is provided with a coupling 54 functioning as an input portion for receiving a force for driving the developing device, more particularly, for driving the developing roller 3*a*. Similarly to the coupling 53, the coupling 54 is engageable with a main assembly coupling 40 which is provided movably in the front-rear direction to receive a driving force from a motor (unshown) provided in the image forming apparatus 100.

Figure 4:
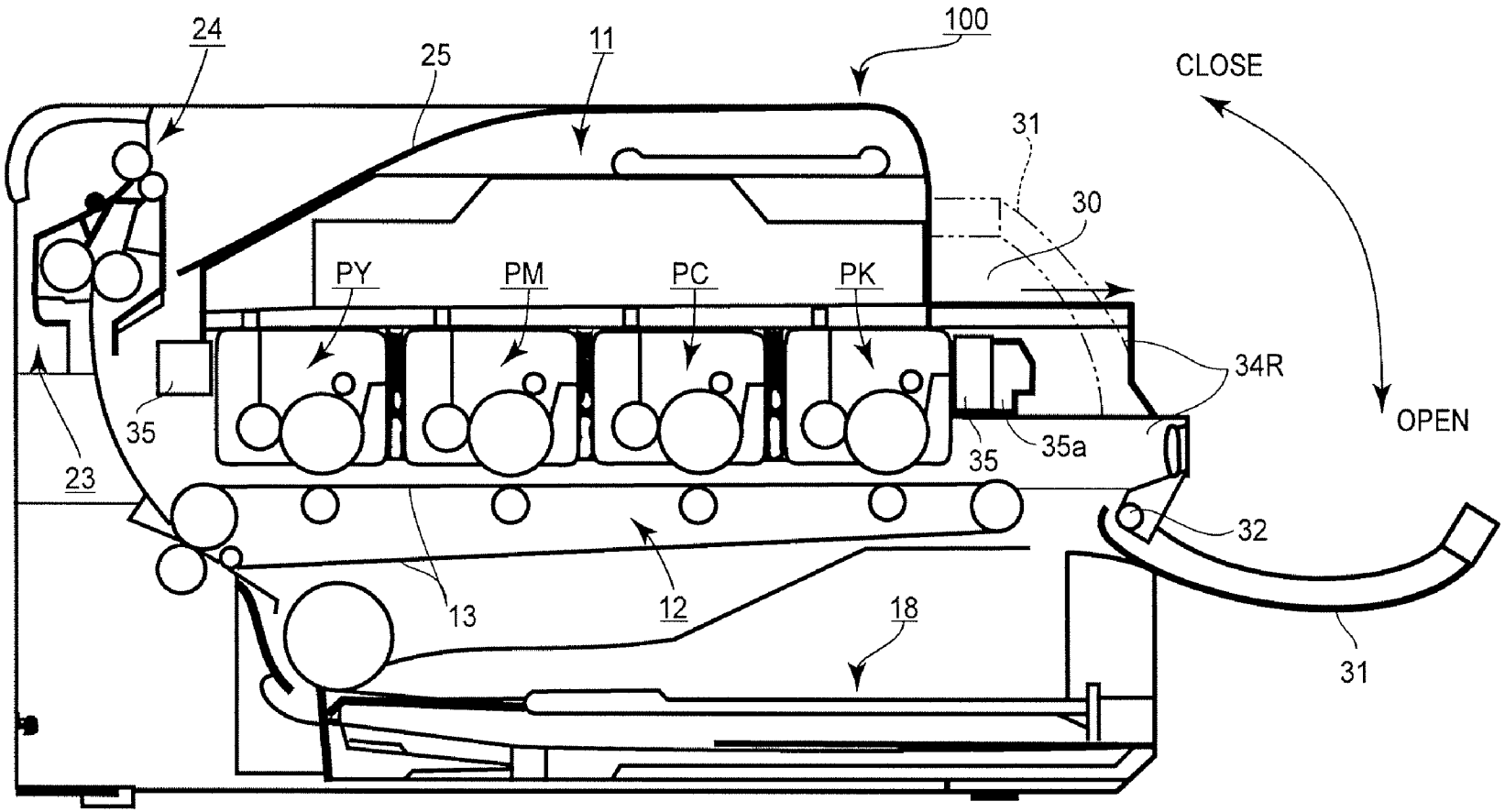
FIG. 4 is a sectional view of the electrophotographic image forming apparatus.
Figure 5:
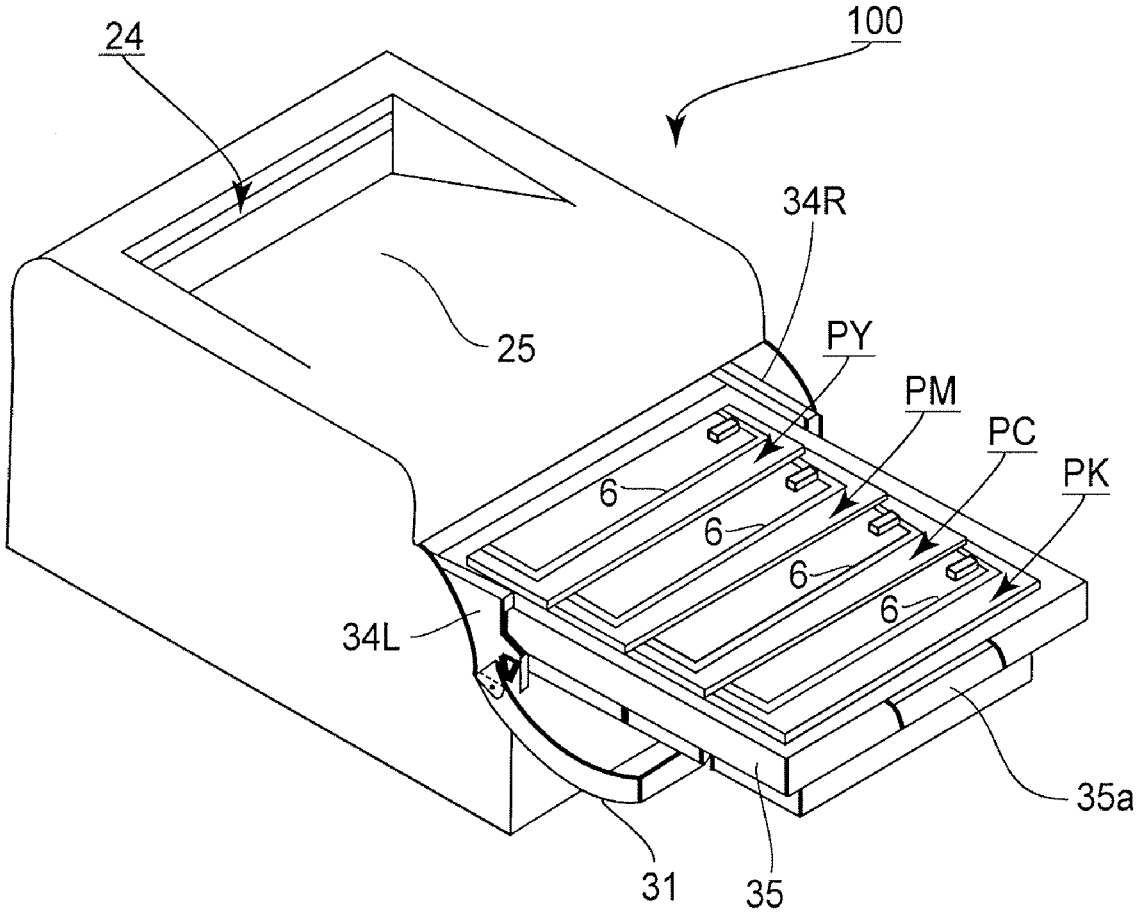
FIG. 5 is a perspective view of the electrophotographic image forming apparatus.

As shown in FIGS. 2 and 4, the first cartridge PY includes a developing unit 3 accommodating yellow (Y) toner to form a Y color toner (developed) image on the surface of the photosensitive drum 1. The second cartridge PM includes a developing unit 3 accommodating magenta (M) toner to form an M color toner (developed) image on the surface of the photosensitive drum 1. The third cartridge PC includes a developing unit 3 accommodating cyan (C) toner to form a C color toner (developed) image on the surface of the photosensitive drum 1. The fourth cartridge PK includes a developing unit 3 accommodating black (K) toner to form a K color toner (developed) image on the surface of the photosensitive drum 1.

Above the cartridges PY, PM, PC, PK, there is provided a laser scanner unit 11. The scanner unit 11 outputs a laser beam L modulated in accordance with image information for each color inputted from the external host apparatus. The laser beam scans the drum surface of the cartridges PY, PM, PC, PK through the exposure port provided in the upper surface.

Below the cartridges PY, PM, PC, PK, there is provided an intermediary transfer belt unit 12. The belt unit 12 is an intermediary transfer member of dielectric material and comprises a flexible endless belt 13, a driving roller 14, a turn roller 15, and a tension roller 16, wherein the driving roller 14, the turn roller 15 and the tension roller 16 function to circulate the belt 13. The driving roller 14 and the tension roller 16 are disposed at the left side in the image forming apparatus 100. The turn roller 15 is disposed at the righthand side in the image forming apparatus 100. The photosensitive drum 1 of each of the cartridges PY, PM, PC, PK is contacted to the upper travelling side of the belt 13. Inside the belt 13, four primary transfer rollers 17 are disposed opposed to the photosensitive drum 1 of the cartridges PY, PM, PC, PK with the upper travelling side of the belt interposed therebetween. To the driving roller 14, the belt 13 is contacted by a secondary transfer roller 22.

Below the belt unit 12, there is provided a feeding unit 18. The feeding unit 18 includes a feeding tray 19, a feeding roller 20, a separation pad 21 and so on. The feeding tray 19 is drawable from the front side of the main assembly of the apparatus 100.

At the left upper side of the image forming apparatus 100, there are provided a fixing device 23 and a pair of discharging rollers. The top surface of the main assembly of the apparatus is a discharging tray 25. The fixing device 23 comprises a fixing film assembly 23*a* and a pressing roller 23*b*. The pair of discharging rollers is constituted by a discharging roller 24*a* and a discharging roller 24*b*.

(Drawing Member of Main Assembly of Electrophotographic Image Forming Apparatus)

The drawing member which is a cartridge tray 35 will be described.

Figure 6:
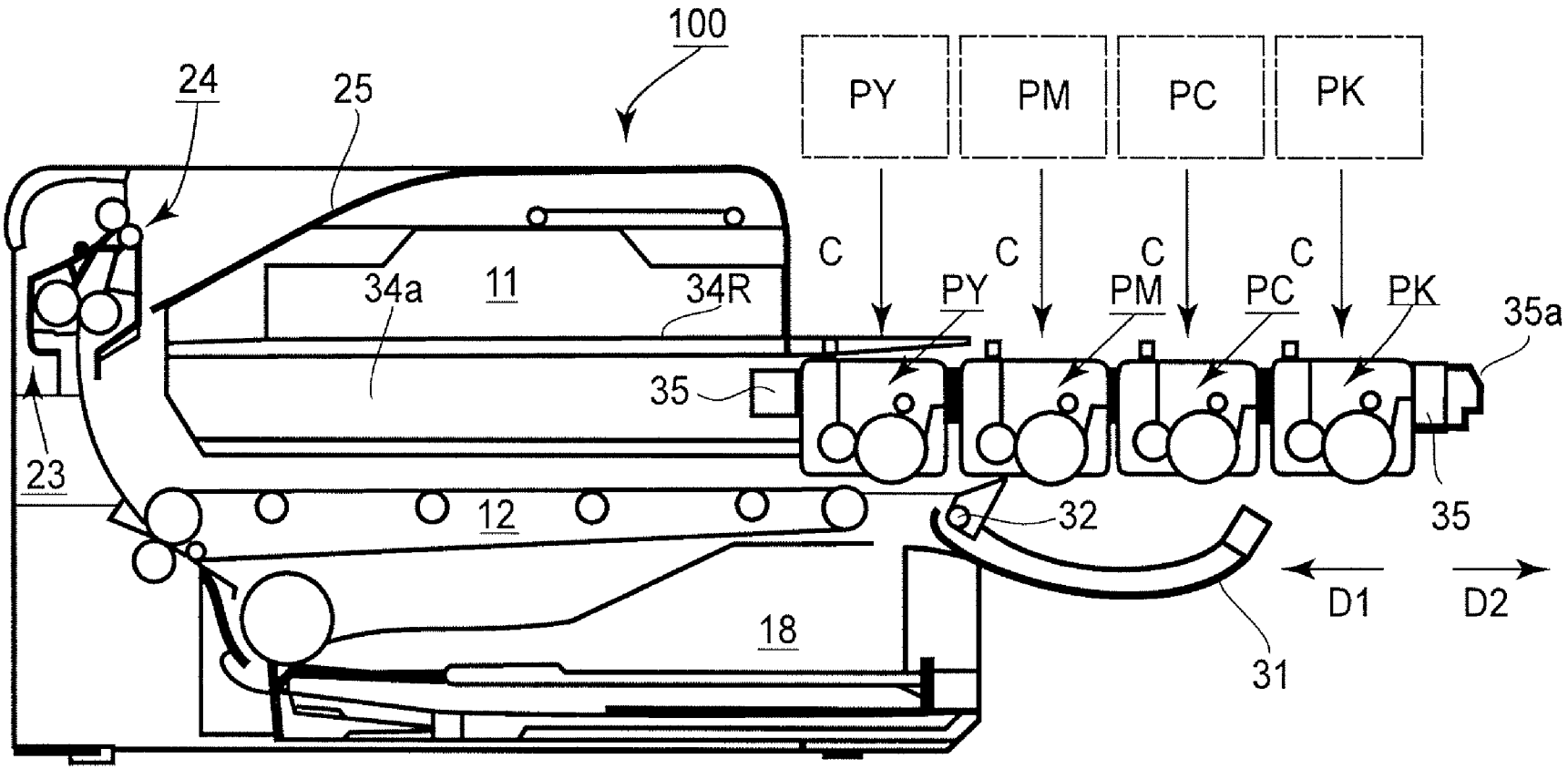
FIG. 6 is a sectional view of the electrophotographic image forming apparatus.

As shown in FIG. 6, the cartridge tray 35 is movable (drawable) from the image forming apparatus 100 in D1, D2 directions, and is movable between the mounted position in the image forming apparatus 100 as shown in FIG. 2 and a drawn position where the cartridge tray 35 is retracted out of the mounting as shown in FIG. 6. In the state that the cartridge tray 35 is at the drawn position, the cartridges PY, PM, PC, PK are mounted on the cartridge tray 35 in the direction indicated by an arrow C. As shown in FIG. 4, the cartridges PY, PM, PC, PK are advanced into the image forming apparatus 100 together with the cartridge tray 35 carrying them. At this time, the cartridges PY, PM, PC, PK move with the space kept between the photosensitive drum 30 and the intermediary transfer belt 13 provided at the lower position. When the cartridge tray 35 is placed at the mounted position, the cartridges PY, PM, PC, PK are positioned by positioning portions (unshown) provided in the image forming apparatus 100. Therefore, the user inserts the cartridge tray 35 into the main assembly of the apparatus, and closes the door 31, which actions are enough to properly mount the cartridges PY, PM, PC, PK to the image forming apparatus 100. The operationality is improved over the structure in which the cartridges PY, PM, PC, PK are individually mounted into the image forming apparatus 100 by the user.

The cartridge tray 35 is drawable in the left-right direction relative to tray holding members 34R, 34L (that is, a substantial horizontal) direction which crosses the axial direction of the photosensitive drum 1. The tray holding members 34R, 34L are movable in interrelation with the movement of the door 31. The door 31 is rotatable about an axis of a shaft 32 relative to the image forming apparatus 100, and it is movable between a close position for closing the opening 30 as shown in FIG. 1 and an open position for opening the opening 30 as shown in FIG. 4.

(Interrelating Mechanism Between Door and Tray Holding Member)

Figure 10:
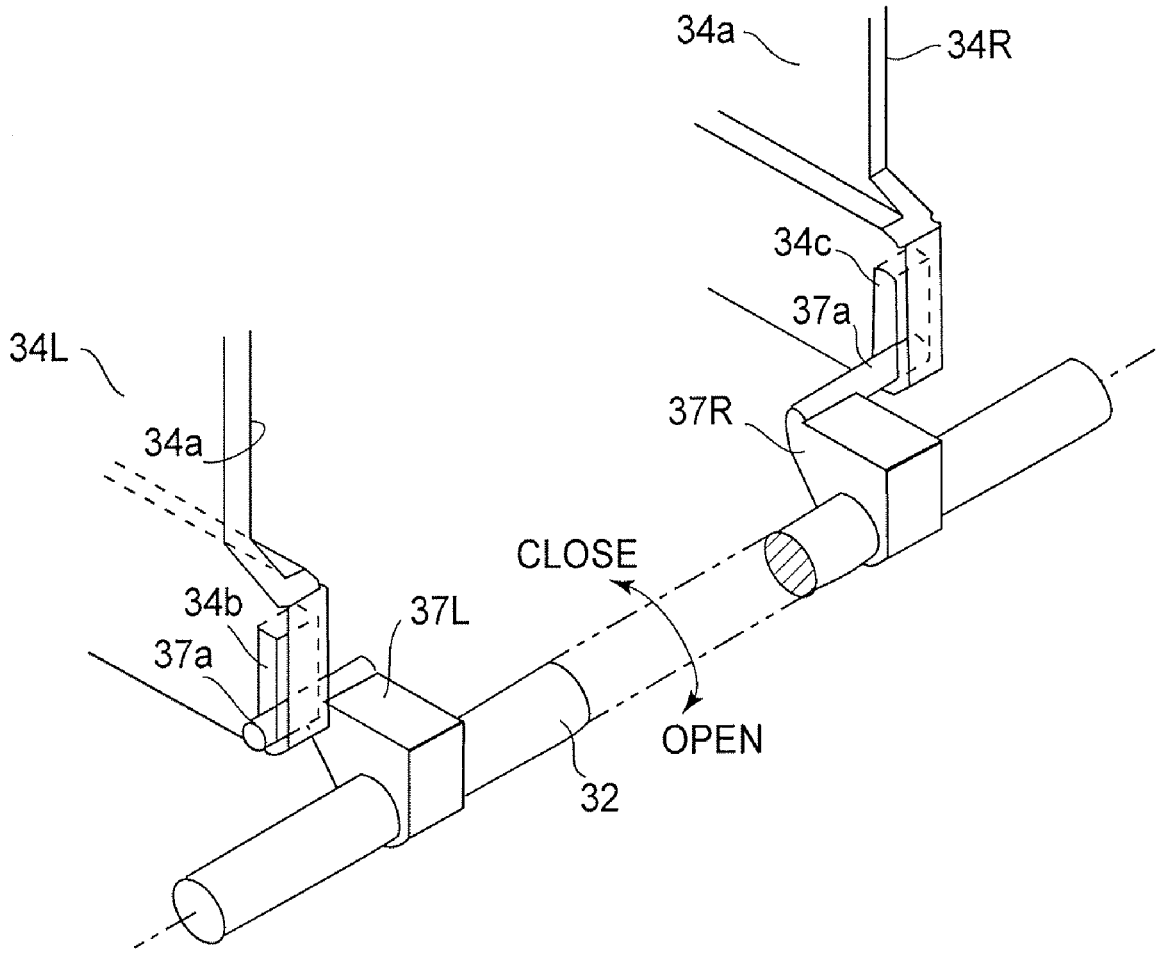
FIG. 10 is a perspective view of an interrelating mechanism portion for interrelating a door and a tray holding member.
Figure 11:
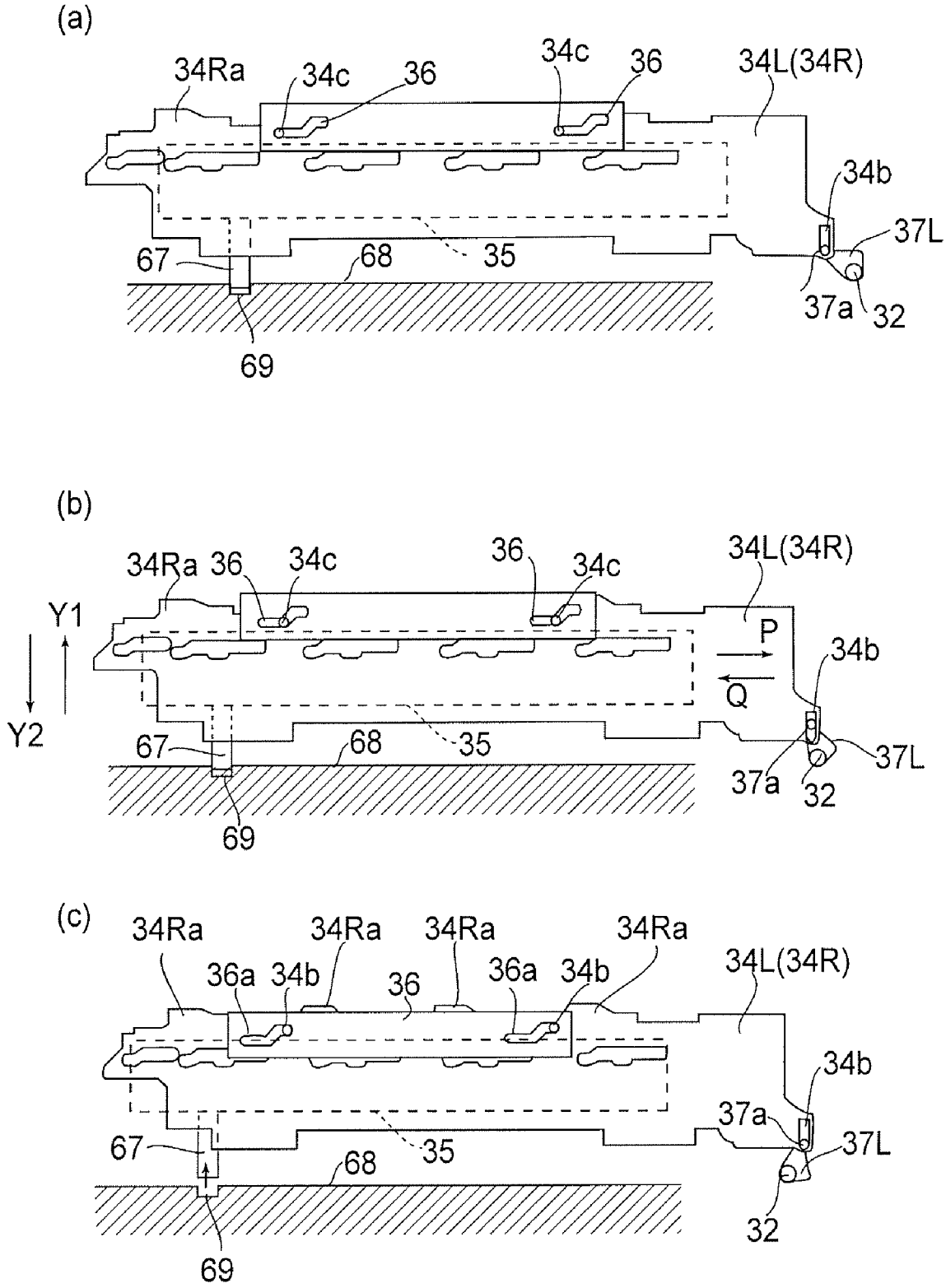
FIGS. 11(*a*)-11(*c*) illustrate movement of the tray holding member interrelated with the door.
Figure 12:
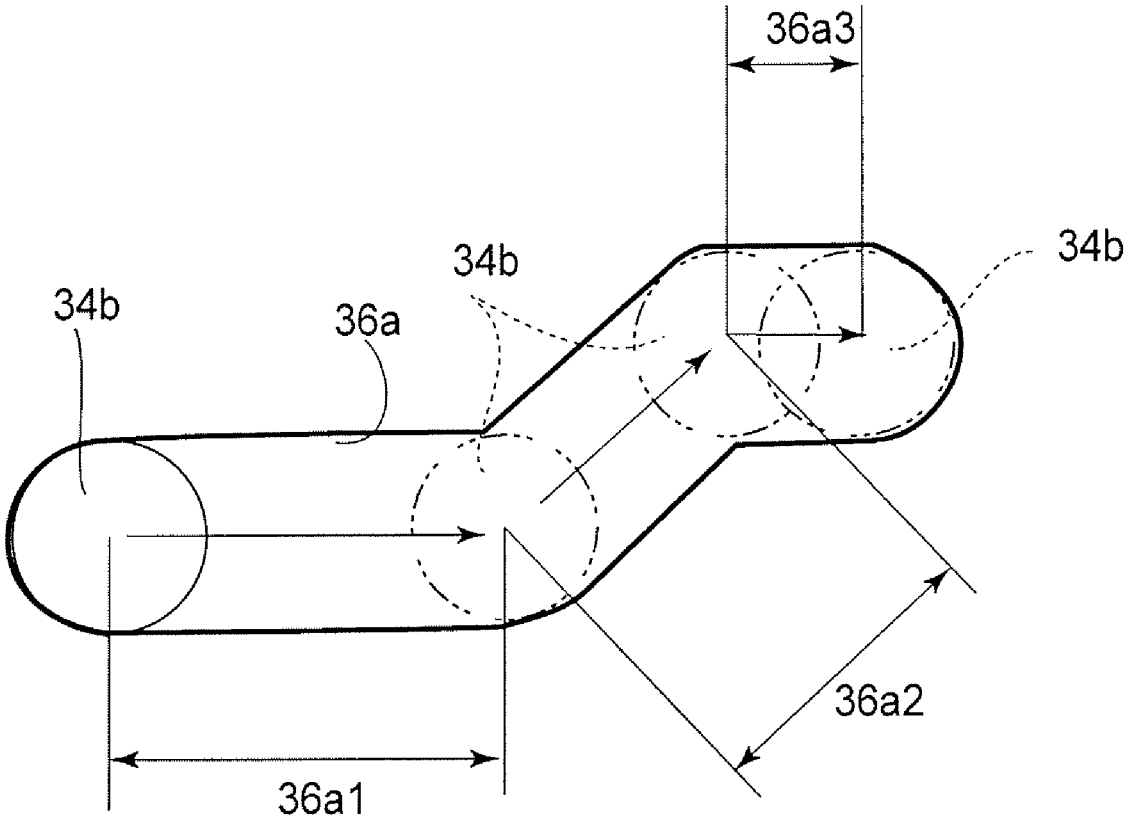
FIG. 12 is an enlarged view of an enlarged view of a guide hole portion.

When the cartridge is taken out of the image forming apparatus 100, the door 12 is moved from the close position to the open position. With the movement of the door 31, arms 37R, 37L provided on the door 31 rotate clockwise about the axis of the shaft 32, as shown in FIGS. 10, 11(*a*), and 11(*b*). Here, as shown in FIG. 11(*b*), projections 37*a* provided on the arms 37R, 37L are engaged with elongated holes 34*c* formed in the tray holding members 34R, 34L. Therefore, the movement of the door 31 moves the tray holding members 34R, 34L in the direction indicated by an arrow P. The tray holding members 34R, 34L are guided by a guiding plate 36 provided in the main assembly of the apparatus 100. In other words, the guiding shaft 34*b* provided on each of the tray holding members 34R, 34L is guided by the guide holes 36*a*, 36*b* provided in the guiding plate 36. The guide holes 36*a*, 36*b*, as shown in FIG. 12, each include a horizontal portion 36*a*1, an inclined portion 36*a*2 extending from the horizontal portion 36*a*1 and inclining upwardly, and a horizontal portion 36*a*3 extending from the inclined portion 36*a*2. Therefore, as shown in FIGS. 11(*a*) and 11(*b*), when the door 31 position, the guiding shaft 34*b* is guided by the horizontal portion 36*a*1, the inclined portion 36*a*2 and the horizontal portion 36*a*3 in the order named. Therefore, the tray holding members 34R, 34L move away from the transfer belt 13 in the direction of arrow y1. At this time, the projection 67 of the cartridge tray 35 engaged with the positioning portion 69 of the main assembly 100 moves in the direction of arrow y1, and therefore, the cartridge tray 35 becomes movable in the left-right direction. In this state, the cartridge tray 35 moves through the opening 30 in the direction of arrow D2 as shown in FIG. 6 to the outside of the image forming apparatus 100. When the guiding shaft 34*b* is guided by the horizontal portion 36*a*1, the main assembly coupling 39 and the main assembly coupling 40 are retracted. By doing so, the engagement between the coupling 53 and the main assembly coupling 39, and the engagement between the coupling 54 and the main assembly coupling 40 are released.

A description will be provided as to the case of mounting the cartridges PY, PM, PC, PK into the image forming apparatus 100. As shown in FIG. 6, in the state that the door 31 is in the open position, the cartridge tray 35 is advanced into the image forming apparatus 100 through the opening 30 in the direction of arrow D1. Thereafter, as shown in FIG. 2, the door 31 is moved to the close position. With movement of the door 31, the arms 37R, 37L provided on the door 31 rotate counterclockwise about the axis of the shaft 32, as shown in FIGS. 11(*c*) and 11(*b*). As shown in FIG. 11 (*b*), the projections 37*a* provided on the arms 37R, 37L are engaged with the elongated holes 34*c* formed in the tray holding members 34R, 34L, as described hereinbefore. Therefore, the movement of the door 31 moves the tray holding members 34R, 34L in the direction indicated by an arrow Q. Therefore, as shown in FIGS. 11(*a*) and 11(*b*), when the door 31 is moved to the close position, the guiding shaft 34*b* is guided by the horizontal portion 36*a*3, the inclined portion 36*a*2 and the horizontal portion 36*a*1 in the order named. Therefore, the tray holding members 34R, 34L are moved in the direction of arrow y2 toward the transfer belt 13. At this time, the projection 67 also moves in the direction of arrow y2 to engage with the positioning portion 69, and therefore, the movement of the cartridge tray 35 is regulated in the left-right direction. When the guiding shaft 34*b* is guided by the horizontal portion 36*a*1, the main assembly coupling 39 and the main assembly coupling 40 are moved forwardly. By doing so, the engagement between the coupling 53 and the main assembly coupling 39, and the engagement between the coupling 54 and the main assembly coupling 40 are established.

(Spacer Member)

A description will provided as to the spacer member 92.

Figure 9:
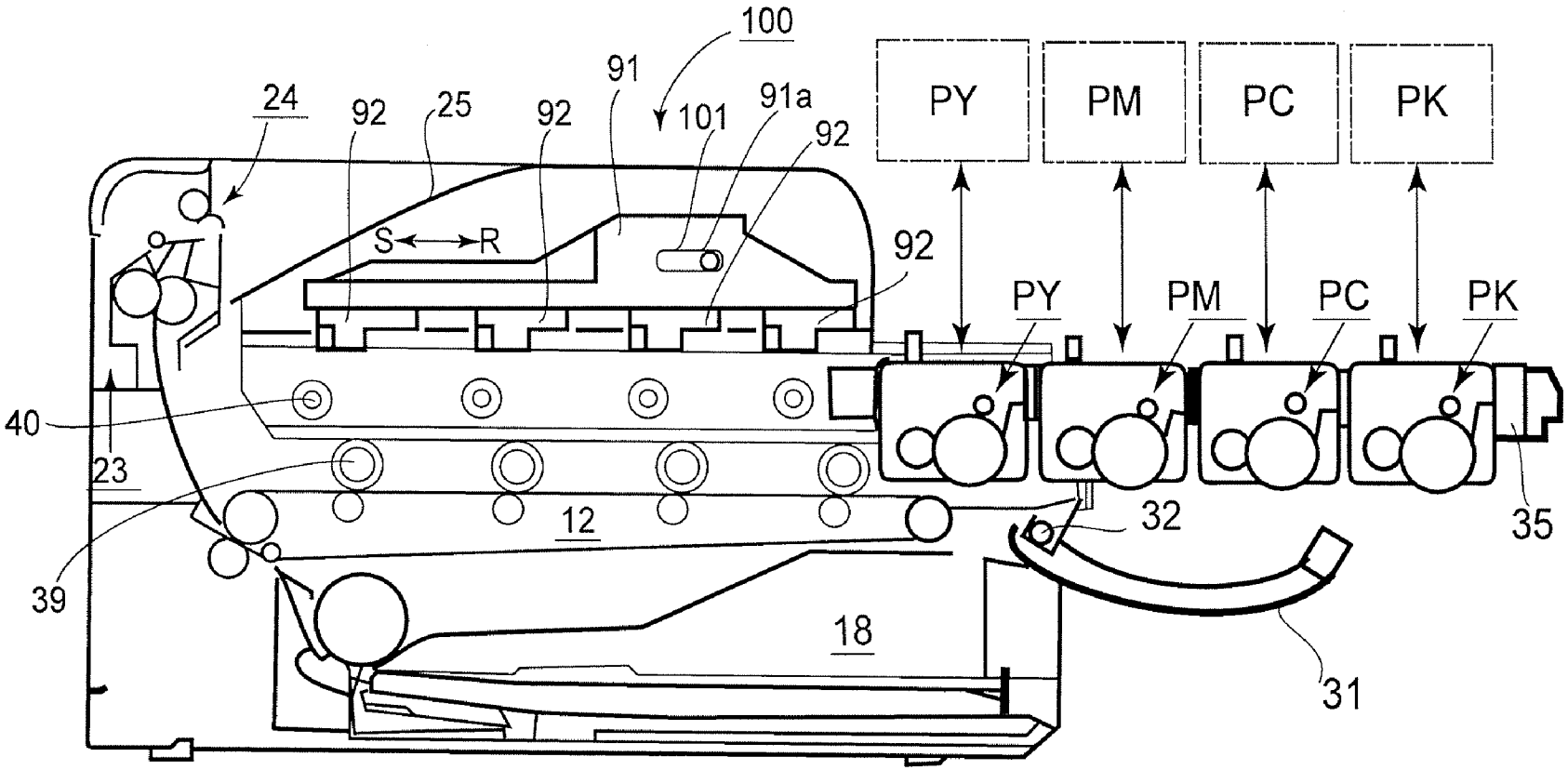
FIG. 9 is a sectional view of the electrophotographic image forming apparatus.
Figure 13:
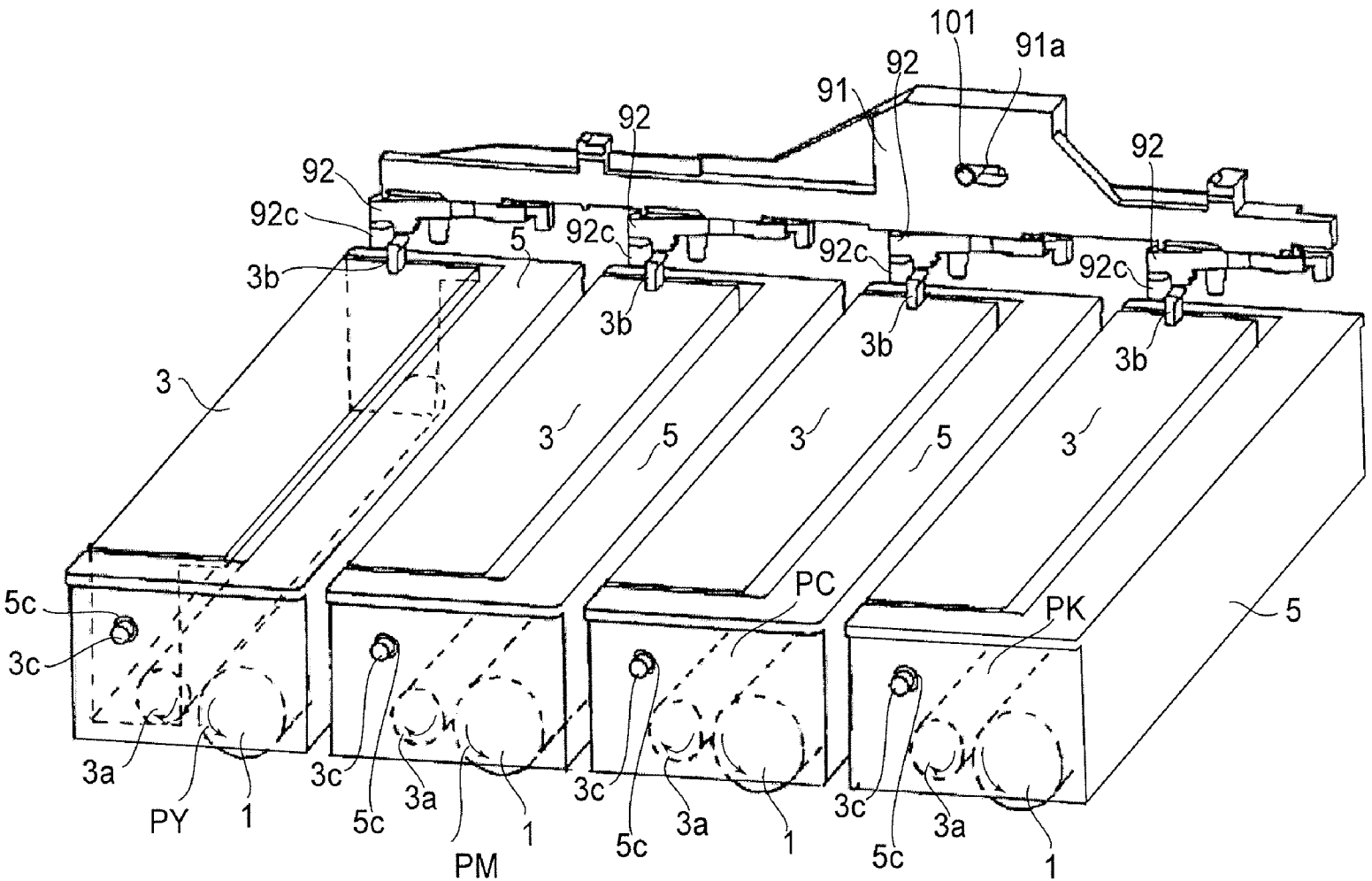
FIG. 13 is a perspective view illustrating a relation between a spacer member and a process cartridge.
Figure 14:
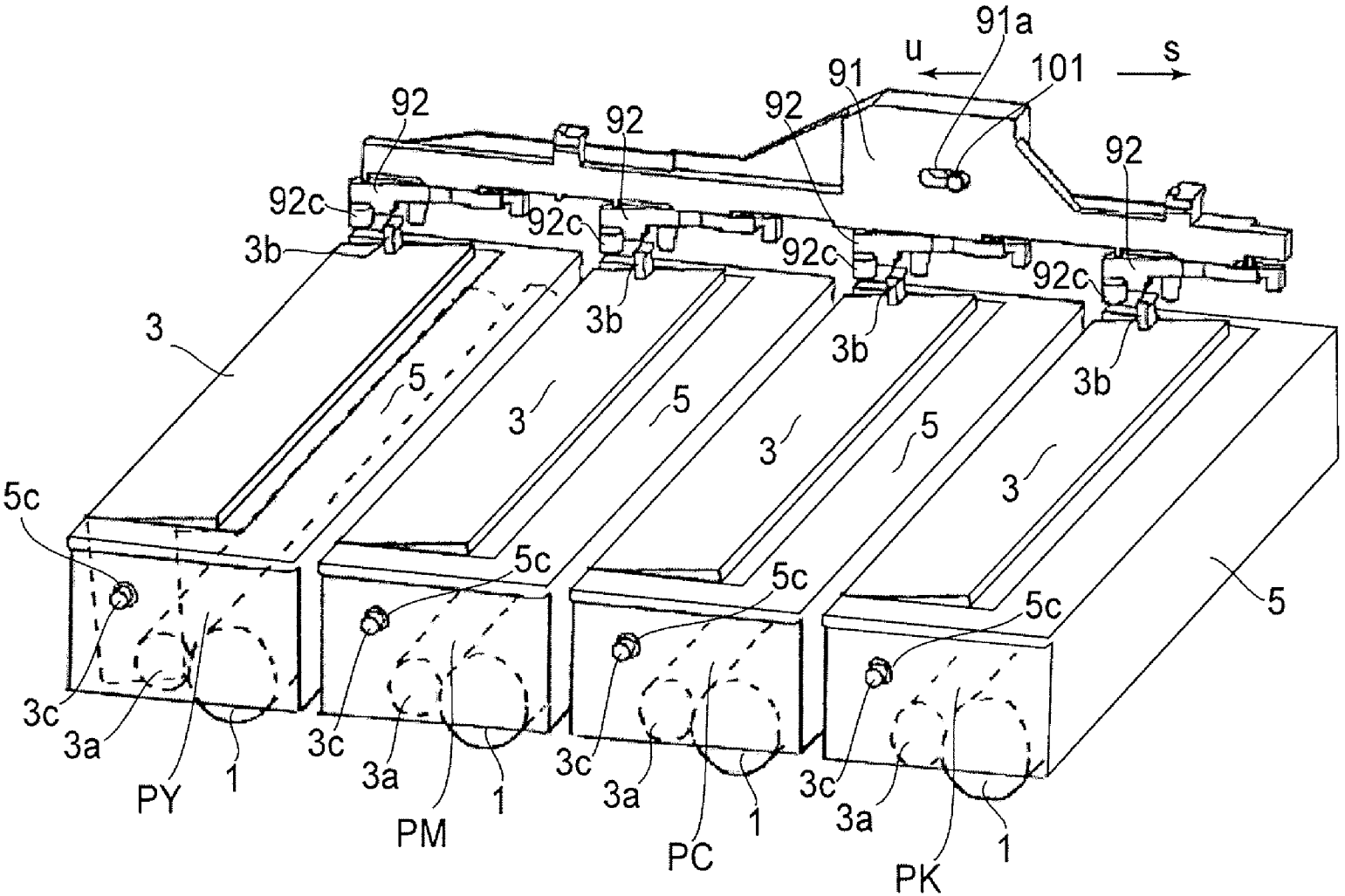
FIG. 14 is a perspective view illustrating a relation between the spacer member and the process cartridge.

As shown in FIGS. 13, 14, and 9, four spacer members 92 actable on the respective cartridges PY, PM, PC, PK are rotatably mounted on the movable member 91, which is also called a spacing plate. The movable member 91 is disposed above the tray holding member 34R at the rear side in the main assembly of the apparatus.

As described hereinbefore, the cartridges PY, PM, PC, PK are inserted into the image forming apparatus 100 together with the cartridge tray 35 while being carried on the cartridge tray 35. At this time, the spacer member 92 is at the retracted position which is retracted, in the front-rear direction (axial direction of photosensitive drum 1), from the movement path v1 of the cartridges PY, PM, PC, PK by the cartridge tray 35. In this state, the door 31 is placed at the open position. And, the engaging portion 34Ra provided on the tray holding member 34R is engaged with the contact portion 92*a* of the spacer member 92. Thus, the spacer member 92 is moved to the retracted position shown in FIG. 16 (*a*) by rotating clockwise about the rotation axis 92*b*. In the retracted position, the spacer member 92 is outside the movement path of the cartridges PY, PM, PC, PK in the axial direction of the photosensitive drum 1 to permit insertion of the cartridges PY, PM, PC, PK. Thus, even if the cartridge PY is inserted into the image forming apparatus 100, if the spacer member 92 for another cartridge PM, PC, PK is in the movement path, the projection 3*b* of the cartridge PY abuts the spacer member 92 so that cartridge PY cannot be inserted. In addition, even if the cartridge PM is inserted into the image forming apparatus 100, if the spacer member 92 for another cartridge PC, PK is in the movement path, the projection 3*b* of the cartridge PM abuts the spacer member 92 so that cartridge PY cannot be inserted. Furthermore, even if the cartridge PM is inserted into the image forming apparatus 100, if the spacer member 92 for another cartridge PK is in the movement path, the projection 3*b* of the cartridge PM abuts the spacer member 92 so that cartridge PY cannot be inserted. Therefore, it is necessary to move the spacer member 92 to the retracted position. Therefore, the spacer member 92 for the cartridge PY which is most downstream with respect to the mounting direction of the cartridge tray 35 (arrow T) may be normally placed at the operation position which is in the movement path v1.

Figure 16A:
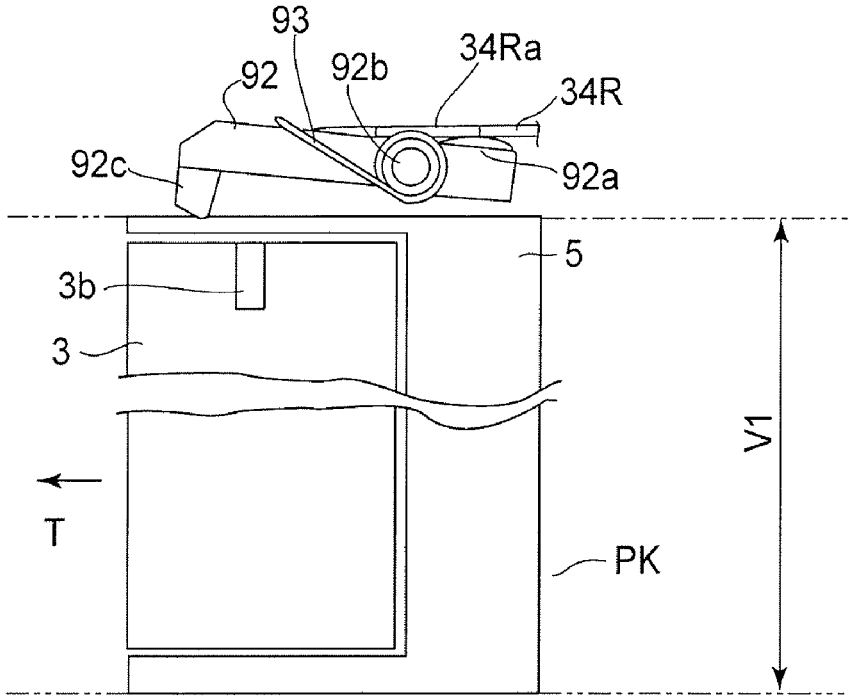
FIGS. 16(*a*)-16(*c*) are top plan views illustrating a relation between the spacer member and the process cartridge.
Figure 16B:
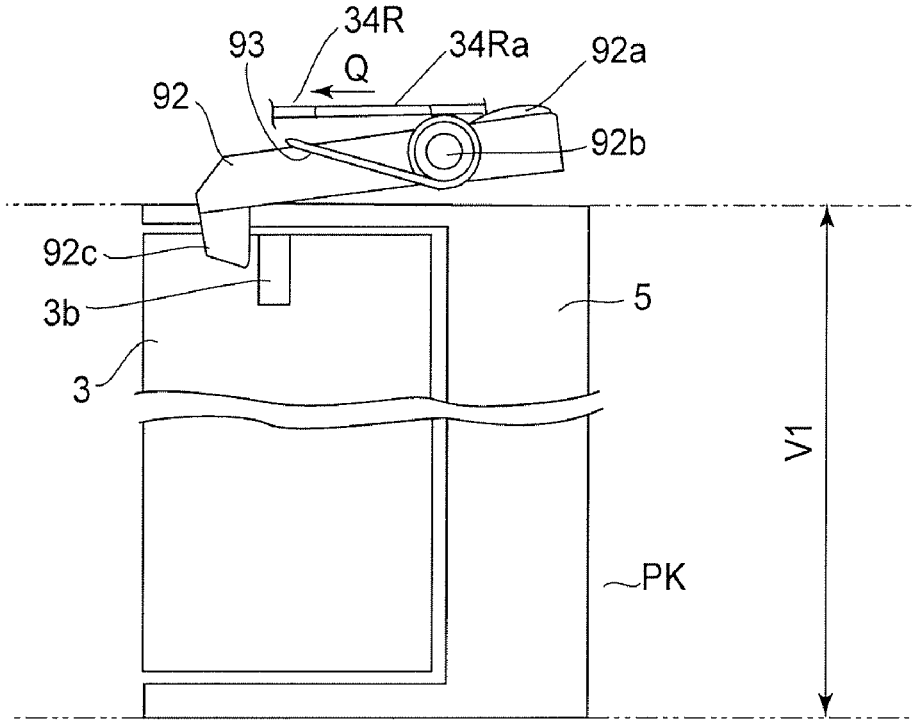
Figure 16C:
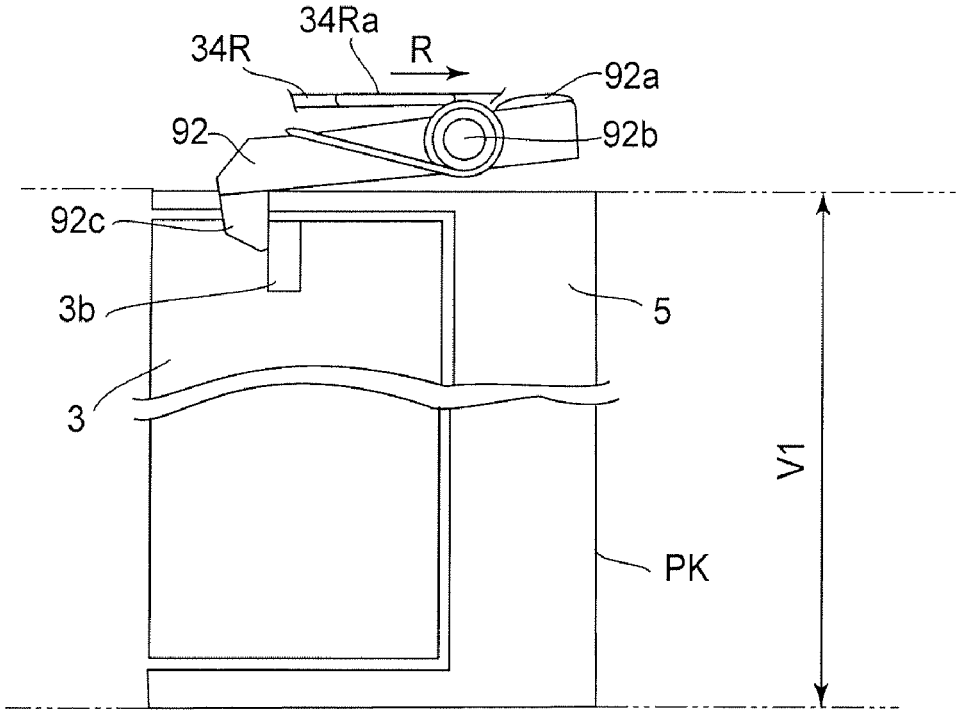

After the cartridge tray 35 is inserted into the image forming apparatus 100, by moving the door 31 from the open position to the close position, the tray holding member 34R (connecting member) moves in the direction of arrow Q. With this operation, as shown in FIG. 16(*b*), the engagement between the engaging portion 34Ra and the contact portion 92*a* is released. Then, the urging force of the urging member 93 moves the spacer member 92 to the operation position, that is, into the movement path v1 of the cartridge PM, PC, PK carried on the cartridge tray 35. At this time, the engaging portion 92*c* of each of the spacer members 92 and the projection 3*b* of the cartridges PY, PM, PC, PK are not yet engaged with each of each other. The position of the movable member 91 at this time (supporting the spacer member 92) is called a first position. In this state, the developing unit 3 is placed at the contact position where the photosensitive drum 1 and the developing roller 3*a* are contacted to each other. Thereafter, by the driving force from a driving source (unshown) provided in the image forming apparatus 100, the movable member 91 is moved in the direction of arrow R while the hole 91*a* is being guided by the guiding shaft 101, and the spacer member 92 is also moved in the direction of arrow R. The position of the movable member 91 supporting the spacer member 92 at this time is the second position. By this movement, the engaging portion 92*c* urges the projection 3*b*, as shown in FIG. 13. By doing so, the developing unit 3 is moved from the contact position to the spacing position. With this operation, the photosensitive drum 1 and the developing roller 3*a* are spaced from each other. Before the start of the image forming operation, or when the main switch of the image forming apparatus 100 has not been actuated, the spaced position of the developing unit 3 is maintained. In this embodiment, the spacer member 92 is engaged with the projection 3*b*. However, in place of the projection 3*b* in the upper surface of the developing unit 3, a recess formed in the upper surface is usable.

With such an arrangement, the developing roller 3*a* can be moved toward and away from the photosensitive drum 1 in an image forming apparatus 100 having the cartridge tray 35 which is movable in the left-right direction. By the structure in which the spacer member 92 is movable between the spacing position and the operation position in the front-rear direction (axial direction of photosensitive drum 1) as described above, the image forming apparatus 100 can be downsized particularly in the vertical direction.

(Full-Color Image Forming Operation)

A description will be provided as to the operation for forming a full-color image.

As shown in FIG. 2, upon the start of the image forming operation, the drums 1 of the cartridges PY, PM, PC, PK and the developing rollers 3*a* thereof rotate at the predetermined speed in the direction of the arrow. The belt 13 also rotates in the clockwise direction as indicated by the arrow (codirectional with the drum rotation) at the speed corresponding to the speed of the drum 1. As shown in FIG. 14, the spacing plate 91 is moved in the direction of an arrow u so that developing device spacing lever 92 is brought into a state of not urging the engaging portion 3*b*. By this, the developing unit 3 is rotated about the shaft 3*c* to move to the contact position. In other words, the spaced state between the developing roller 3*a* and the drum 1 is released, so that developing rollers 3*a* in the cartridges are brought into contact to the respective drums 1 by the springs 7 provided in the respective cartridge.

In synchronism with this operation, the charging rollers 2 electrically charge, at predetermined control timing, the surface of the drum 1 uniformly to the predetermined potential in the cartridges PY, PM, PC, PK. The scanner unit 11 scans the surfaces of the drums 1 with the laser beam modulated in accordance with the respective image signals to expose the surface of the drum 1 to the laser beam. By this, an electrostatic latent image is formed on the surface of the drum 1 corresponding to the image signals for the respective colors. The thus formed electrostatic latent images are developed by the respective developing units 3 into toner images.

Through such an electrophotographic image forming process operation, a Y chromatic toner image corresponding to a yellow component of the full-color image is formed on the drum 1 of first cartridge PY, and the toner image is transferred onto the belt 13 (primary transfer).

An M chromatic toner image corresponding to magenta component of the full-color image is formed on the drum 1 of second cartridge PM, and the toner image is transferred onto the belt 13 (primary transfer) superimposedly on the already transferred Y chromatic toner image.

A C chromatic toner image corresponding to cyan component of the full-color image is formed on the drum 1 of third cartridge PC, and the toner image is transferred onto the belt 13 (primary transfer) superimposedly on the chromatic toner images already transferred.

A K toner image corresponding to black component of the full-color image is formed on the drum 1 of the fourth cartridge PC, and the toner image is transferred onto the belt 13 (primary transfer) superimposedly on the chromatic toner images already transferred.

Thus, an unfixed toner image of the full-color (4 colors) is formed on the belt 13.

In each of the cartridges PY, PM, PC, PK, the untransferred toner remaining on the surface of the drum 1 after the primary transfer of the toner image onto the belt 13, is removed by the cleaning blade 4.

After completion of the primary transfer, the spacing plate 91 is moved in the direction of an arrow S shown in FIG. 14 to bring the developing roller 3*a* and the drum 1 into the spaced state.

On the other hand, the feeding roller 20 is driven at the predetermined control timing. By this, the top one of the sheets (recording material) stacked on the feeding tray 19 is separated and fed into the nip between the transfer roller 22 and the belt 13 (secondary transfer nip). By this, the sheet P is fed through the nip, during which the four color toner image is sequentially transferred from the belt 13 onto the surface of the sheet P.

The sheet P is separated from the surface of the belt 13 and is introduced to the fixing device 23, where the toner image is heated and pressed. By this, the toner images of the respective colors are mixed and fixed. Then, the sheet P is discharged out of the fixing device 23 to the discharging tray 25 by the pair of discharging rollers 24 as a full-color print.

The remaining toner untransferred in the secondary transfer operation which remains on the surface of the belt 13 after separation of the sheet is electrostatically transferred back onto the surface of the drum 1 in the primary transfer portion and is removed by the cleaning blade 4 in this embodiment.

In this embodiment, the developing rollers 3*a* and the drums 1 of the cartridges are contacted or spaced all together. However, from the standpoint of suppressing wearing of the chromatic color cartridges during the monochromatic mode operations, the developing roller 3*a* of the black (K) toner cartridge PK, and the developing rollers 3*a* of the chromatic color cartridges (the, M, C) may be contacted and spaced relative to the associated drums 1, independently from each other.

As described in the foregoing, according to the present invention, the developing roller or developing rollers can be spaced from the photosensitive drum or respective drums and can be contacted to the photosensitive drum or the respective photosensitive drums in the electrophotographic image forming apparatus having the drawing member to which a plurality of process cartridges are detachably mountable and which is movable in the substantially horizontal direction crossing with the axial direction of the electrophotographic photosensitive drum.

In addition, the electrophotographic image forming apparatus can be downsized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 004105/2006 and 346205/2006 filed Jan. 11, 2006 and Dec. 22, 2006 respectively, which are hereby incorporated by reference.

What is claimed is:

1. An electrophotographic image forming apparatus for forming an image on a recording material, to which a plurality of process cartridge are detachably mountable, each process cartridge including an electrophotographic photosensitive drum, a developing roller configured and positioned to develop, with a developer, an electrostatic latent image formed on the electrophotographic photosensitive drum, a first frame supporting the electrophotographic photosensitive drum, and a second frame supporting the developing roller which is movable between a contact position where the developing roller contacts the electrophotographic photosensitive drum and a spacing position where the developing roller is spaced from the electrophotographic photosensitive drum, said apparatus comprising:

a drawing member to which the plurality of process cartridges are detachably mountable, said drawing member being movable in a substantially horizontal direction crossing an axial direction of each electrophotographic photosensitive drum between a mount position where the process cartridges are mounted in a main assembly of said apparatus and a drawn position where said drawing member is drawn out of said main assembly of said apparatus, wherein said drawing member is configured and positioned to support the process cartridges positioned alongside each other horizontally;

a spacer member provided in said main assembly and movable between a retracted position where said spacer member is retracted, in the axial direction of the photosensitive drums, from a movement path of each of the process cartridges to permit movement of each process cartridge mounted on the drawing member and an operating position where said spacer member is in the movement path to move the second frame between the contact position and the spacing position.

2. An apparatus according to claim 1, further comprising:

an opening configured and positioned to permit each process cartridge to be mounted in said electrophotographic image forming apparatus;

a door movable between a close position for closing said opening and an open position for opening said opening; and a connecting member configured and positioned to move said spacer member in interrelation with movement of said door, wherein said connecting member moves said spacer member to the retracted position when said door moves to the open position and wherein said connecting member moves said spacer member to the operating position when said door moves to the close position.

3. An apparatus according to claim 2, further comprising:

a driving source and a movable member supporting said spacer member, wherein said movable member is movable by a driving force from said driving source between a first position where said spacer member is spaced from the second frame to place the second frame at the contact position and a second position where said spacer member is contacted to the second frame to place the second frame at the spacing position.

4. An apparatus according to claim 3, wherein said spacer member is rotatably supported on said movable member.

5. An apparatus according to claim 2, wherein said connecting member movably holds said drawing member.

6. An apparatus according to claim 5, further comprising a transfer belt to which the developed image formed on each electrophotographic photosensitive drum is transferred, wherein said connecting member contacts said transfer belt to said electrophotographic photosensitive drum when said door is at the close position and spaces said transfer belt from each electrophotographic photosensitive drum when said door is at the open position.

7. An apparatus according to claim 2, wherein said spacer member is moved to the retracted position by said connecting member contacting to said spacer member, and said spacer member is moved to the operating position by an urging force by said connecting member disengaging from said spacer member.

* * * * *